US007497746B2

(12) United States Patent
Okuyama

(10) Patent No.: US 7,497,746 B2
(45) Date of Patent: Mar. 3, 2009

(54) METHOD AND SYSTEM FOR STEERING WATERCRAFT

(75) Inventor: Takashi Okuyama, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/047,123

(22) Filed: Jan. 31, 2005

(65) Prior Publication Data

US 2005/0170713 A1 Aug. 4, 2005

(30) Foreign Application Priority Data

Jan. 29, 2004 (JP) ..... 2004-021681

(51) Int. Cl.
*B63H 21/22* (2006.01)

(52) U.S. Cl. ..... 440/1

(58) Field of Classification Search ..... 701/21; 114/144 RE, 144 E; 440/53, 58, 59, 60, 1
See application file for complete search history.

(56) References Cited

U.S. PATENT DOCUMENTS

| | | | | |
|---|---|---|---|---|
| 2,215,003 | A | 9/1940 | Johnson | |
| 2,224,357 | A | 12/1940 | Pecker | |
| 3,084,657 | A | 4/1963 | Kiekhaefer | |
| 3,233,691 | A | 2/1966 | De Biasi | |
| 3,310,021 | A | 3/1967 | Shimanckas | |
| 3,349,744 | A | 10/1967 | Mercier et al. | |
| 4,120,258 | A | 10/1978 | Spurgin | |
| 4,220,111 | A | 9/1980 | Krautkremer et al. | |
| 4,373,920 | A | 2/1983 | Hall et al. | |
| 4,500,298 | A | 2/1985 | Hall et al. | |
| 4,519,335 | A | 5/1985 | Krautkremer et al. | |
| 4,637,802 | A | 1/1987 | Taguchi et al. | |
| 4,787,867 | A * | 11/1988 | Takeuchi et al. | 440/1 |
| 4,872,857 | A * | 10/1989 | Newman et al. | 440/1 |
| 4,908,766 | A * | 3/1990 | Takeuchi | 701/206 |
| 4,909,765 | A | 3/1990 | Riske et al. | |
| 5,029,547 | A | 7/1991 | Novey | |
| 5,031,562 | A | 7/1991 | Nakase et al. | |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Appl. No. 11/384,616, filed Mar. 20, 2006. Title: Steering Control System for Boat.

(Continued)

*Primary Examiner*—Stephen Avila
(74) *Attorney, Agent, or Firm*—Knobbe, Martens, Olson & Bear, LLP

(57) ABSTRACT

A method of steering a watercraft propulsion device mounted to a transom plate and having a steering drive unit which allows the watercraft propulsion device to rotationally move about a swivel shaft. The method can include calculating a steering control amount for the steering drive unit in accordance with the degree of operator's steering wheel displacement and a predetermined steering system response performance, and operating the steering drive unit based on the calculated control physical quantity, in which the predetermined steering system response performance can be, selected from a plurality of plurality of predetermined steering system response performance options.

19 Claims, 5 Drawing Sheets

U.S. PATENT DOCUMENTS

| | | | | |
|---|---|---|---|---|
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 * | 5/2001 | McKenney et al. | 114/150 |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 * | 12/2003 | Andonian et al. | 180/402 |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,892,661 | B2 * | 5/2005 | Kishi et al. | 114/144 R |
| 6,892,662 | B2 * | 5/2005 | Watanabe et al. | 114/144 R |
| 6,994,046 | B2 | 2/2006 | Kaji et al. | |
| 6,997,763 | B2 | 2/2006 | Kaji | |
| 7,004,278 | B2 | 2/2006 | Sugitani et al. | |
| 7,063,030 | B2 | 6/2006 | Mizutani | |
| 2003/0077953 | A1 | 4/2003 | Kaji | |
| 2003/0150366 | A1 * | 8/2003 | Kaufmann et al. | 114/144 RE |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 * | 2/2004 | Kaufmann et al. | 114/144 RE |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1 * | 8/2005 | Okuyama | 440/59 |
| 2005/0199167 | A1 | 9/2005 | Mizutani | |
| 2005/0199168 | A1 | 9/2005 | Mizutani | |
| 2005/0199169 | A1 * | 9/2005 | Mizutani | 114/144 RE |
| 2005/0215131 | A1 | 9/2005 | Oguma et al. | |
| 2005/0282447 | A1 | 12/2005 | Okuyama | |
| 2006/0019558 | A1 | 1/2006 | Mizutani et al. | |
| 2006/0037522 | A1 | 2/2006 | Kaneko et al. | |
| 2007/0049139 | A1 | 3/2007 | Mizutani | |
| 2007/0066154 | A1 | 3/2007 | Mizutani | |
| 2007/0066156 | A1 | 3/2007 | Mizutani | |
| 2007/0066157 | A1 | 3/2007 | Yamashita et al. | |
| 2007/0093147 | A1 | 4/2007 | Mizutani | |
| 2007/0105463 | A1 | 5/2007 | Mizutani | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 03-148395 | 6/1991 |
| JP | 04-038297 | 2/1992 |
| JP | B-HEI 6-33077 | 5/1994 |
| JP | 2739208 B2 | 1/1998 |
| JP | 10-226346 | 8/1998 |
| JP | A-HEI 10-310074 | 11/1998 |
| JP | 2959044 B2 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-2004-155282 | 6/2004 |

OTHER PUBLICATIONS

Co-Pending U.S. Appl. No. 11/354,491, filed Feb. 15, 2006. Title: Steering Control System for Boat.

* cited by examiner

Controlling block diagram

METHOD AND SYSTEM FOR STEERING WATERCRAFT

PRIORITY INFORMATION

This application is based on and claims priority under 35 U.S.C. §119 to Japanese Patent Application No. 2004-021681, filed on Jan. 29, 2004, the entire contents of which is hereby expressly incorporated by reference herein.

BACKGROUND OF THE INVENTIONS

1. Field of the Inventions

The present application relates to a method of and system for steering a watercraft propulsion device.

2. Description of Related Art

Conventionally, cable and hydraulic manual steering systems are used for steering watercraft propulsion devices such as outboard motors and stem drives (hereinafter "outboard motors"). The cable-type steering systems can generate high operational loads. Thus, the hydraulic manual steering systems are more commonly used.

In hydraulic manual steering systems, it is not practicable to include control systems for optimizing steering angles in accordance with watercraft speed. In addition, since hydraulic piping is required for such systems, additional space for the piping is required in the hull. Thus, the design of the system structure is complicated and construction and servicing are time-consuming.

More recently, a "Drive-By-Wire" (DBW) type system has been developed in which steering is electronically controlled using a steering drive unit including an electric motor (see Japanese Patent Publication No. Hei 4-38297, for example). In this system, an outboard motor is mounted to a transom plate and includes a steering drive unit having an electric motor which drives the outboard motor to rotate about a swivel shaft. The method of operating the system includes calculating a control quantity for the steering drive unit in accordance with the degree of operator's steering displacement, and operating the steering drive unit based on the calculated control quantity.

In such conventional method of steering an outboard motor, a control quantity can be directly and unequivocally correlated to the steering wheel displacement. The control command signal, based on the steering angle as the control quantity, is sent to the steering drive unit to control the electric motor so as to maintain the steering drive unit in the desired orientation.

SUMMARY OF THE INVENTION

An aspect of at least one of the inventions disclosed herein includes the realization that other steering modes can be offered to an operator of a watercraft that can provide the operator with options for steering system performance, allowing the operator to tailor the steering system performance to the desired mode of operation. For example, in some circumstances, it is more desirable to have a steering system respond very quickly but more slowly in other circumstances. Additionally, it is more desirable that the effective gain of the steering response be larger in some circumstances, but smaller in other circumstances.

For example, but without limitation, when cruising at elevated speeds, it is more desirable that the steering system respond quickly (less lag) to movements of the steering wheel. Additionally, it is more desirable that the steering system provide a relatively lower effective gain when the watercraft is operating at higher speeds. As used herein, the terms "effective gain" and "gain" refer to the proportional relationship between steering wheel movements and the amount of angular displacement of the propulsion unit about a steering axis. Higher "gain" means that a unit of movement of the steering wheel (e.g. 1 degree) results in an angular displacement of the propulsion unit that is relatively larger than the angular displacement generated by the same steering wheel movements at lower gain values.

On the other hand, when trolling, it is more desirable that the steering system respond more slowly to steering inputs, yet provide a higher gain. Further, when cruising at moderate speeds, it can be more desirable to provide intermediate steering response times and gains.

In accordance with an embodiment, a method of steering a watercraft propulsion device mounted to a transom plate of a watercraft is provided, wherein the propulsion device includes a steering input device configured for operation by an operator of the watercraft and a steering drive unit configured to allow the watercraft propulsion device to swivel about a swivel shaft. The method comprises the steps of detecting a displacement of the steering input device, and detecting which of a plurality of predetermined steering system response performance options has been selected, each of the plurality of predetermined steering system response performance options corresponding to a steering factor indicative of the amount of actuation of the steering drive unit. The method also includes calculating a steering control amount for the steering drive unit in accordance with the degree displacement of the steering input device and the selected predetermined steering system response performance option, and operating the steering drive unit based on the calculated steering control amount.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENTS

Figure 1:
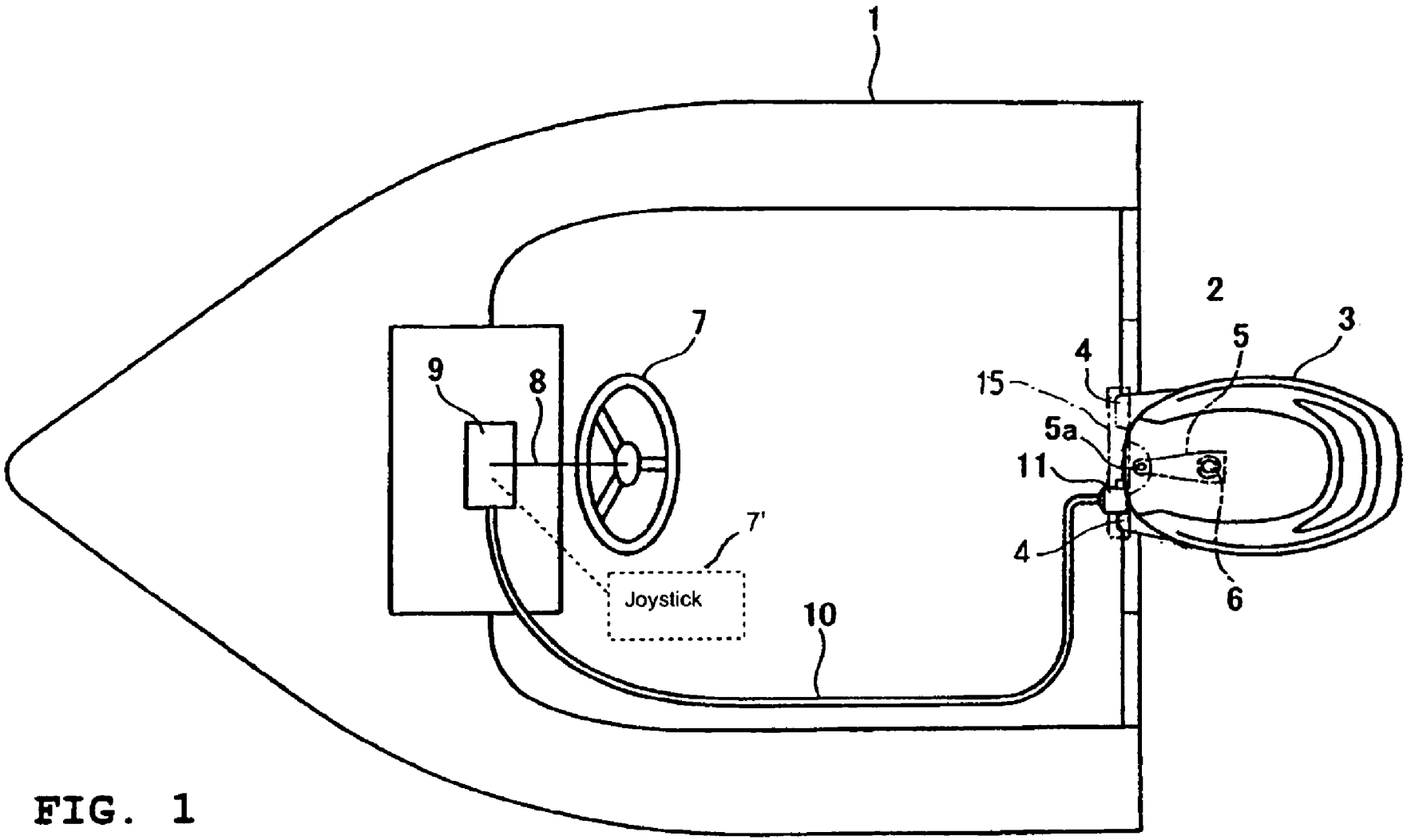
FIG. 1 is an overall plan view of a watercraft having a steering system for steering an outboard motor according to an embodiment.

FIG. 1 is a schematic structural view of a marine propulsion system included on a small boat 1. The embodiments disclosed herein are described in the context of a marine propulsion system of a small boat because these embodiments have particular utility in this context. However, the embodiments and inventions herein can also be applied to other marine vessels, such as personal watercraft and small jet boats, as well as other vehicles.

An outboard motor 3 is mounted to a transom plate 2 of a hull of the boat 1 with clamp brackets 4. The outboard motor 3 is rotatable about a swivel shaft 6. The swivel shaft 6 has an upper end with a steering bracket 5 fixed. The steering bracket 5 has an end 5*a* connected to a steering drive unit 15.

The steering drive unit 15 includes a Direct Drive (DD)-type electric motor, described in greater detail below with reference to FIG. 2, although other actuators can also be used. A steering wheel 7 is provided in front of an operator's seat which is mounted in the boat 1. The degree of displacement of the steering wheel can be detected by a steering angle detecting device 9 through a steering shaft 8. The detected degree of displacement can be sent to a controller 11 of the outboard motor via a cable 10.

In some embodiments, the steering angle signal can be an electric signal. The controller 11 can be configured to drive the steering drive unit 15 based on the steering angle signal to rotate the outboard motor 3 about the swivel shaft 6 to steer the boat 1.

In some embodiments, the degree of steering wheel displacement is detected and converted into a physical quantity with a calculation by a Central Processing Unit (CPU). A control command signal based on the physical quantity is sent to the steering drive unit through a communication line such as an inboard Local Area Network (LAN) and/or Controller Area Network (CAN). The communication line may be wired, such as a copper wire, or wireless, or fiber-optic.

The CPU that executes such a calculation can be mounted in the steering angle detecting device 9 disposed at the steering wheel side, or in the controller 11 disposed at the outboard motor side.

Figure 2:
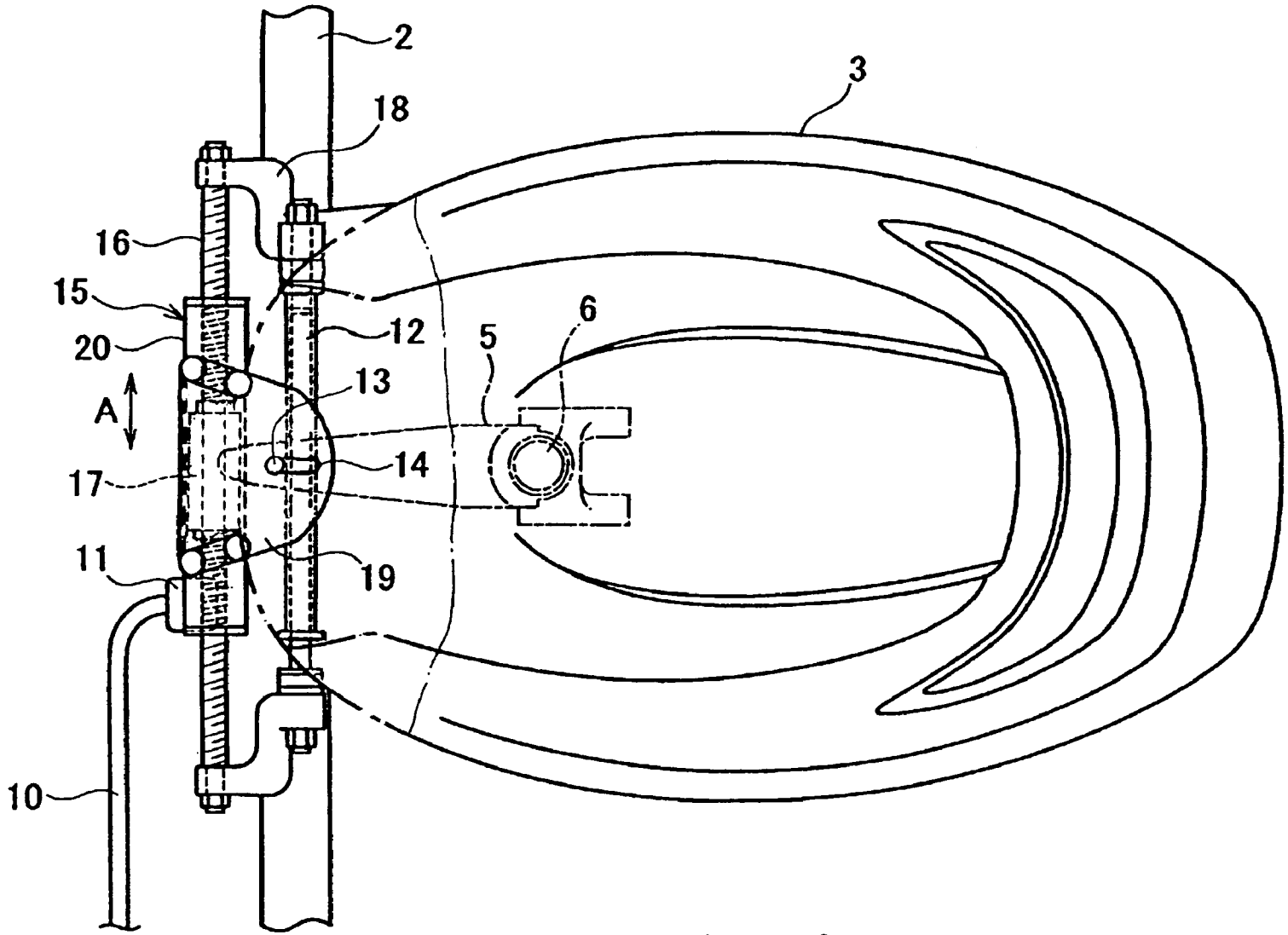
FIG. 2 is an enlarged top plan and partial cut-away view of the steering system and outboard motor of FIG. 1.

FIG. 2 shows a structure of an outboard motor steering device according to an embodiment. The outboard motor 3 can tilt about a tilt shaft 12 for tilting operation. The ends of the tilt shaft 12 are fixed to a ball screw 16 through support members 18. A DD-type motor 17 is mounted on the ball screw 16. The DD-type motor 17 can be mounted in a housing unit 20 and can slide relative to the ball screw 16 together with the housing unit 20, as shown by the arrow A. In some embodiments, the ball screw 16, the DD-type motor 17, and the housing unit 20 form the steering drive unit 15.

A plate-like connecting bracket 19 can be secured to the housing unit 20. The connecting bracket 19 can be connected to the end of the steering bracket 5 through a connecting pin 13. When the connecting bracket 19 slides together with the housing unit 20, as shown by the arrow A, the connecting pin 13 allows the steering bracket 5 to rotationally move about the swivel shaft 6, while moving in a slot 14 formed in the steering bracket 5.

Figure 4:
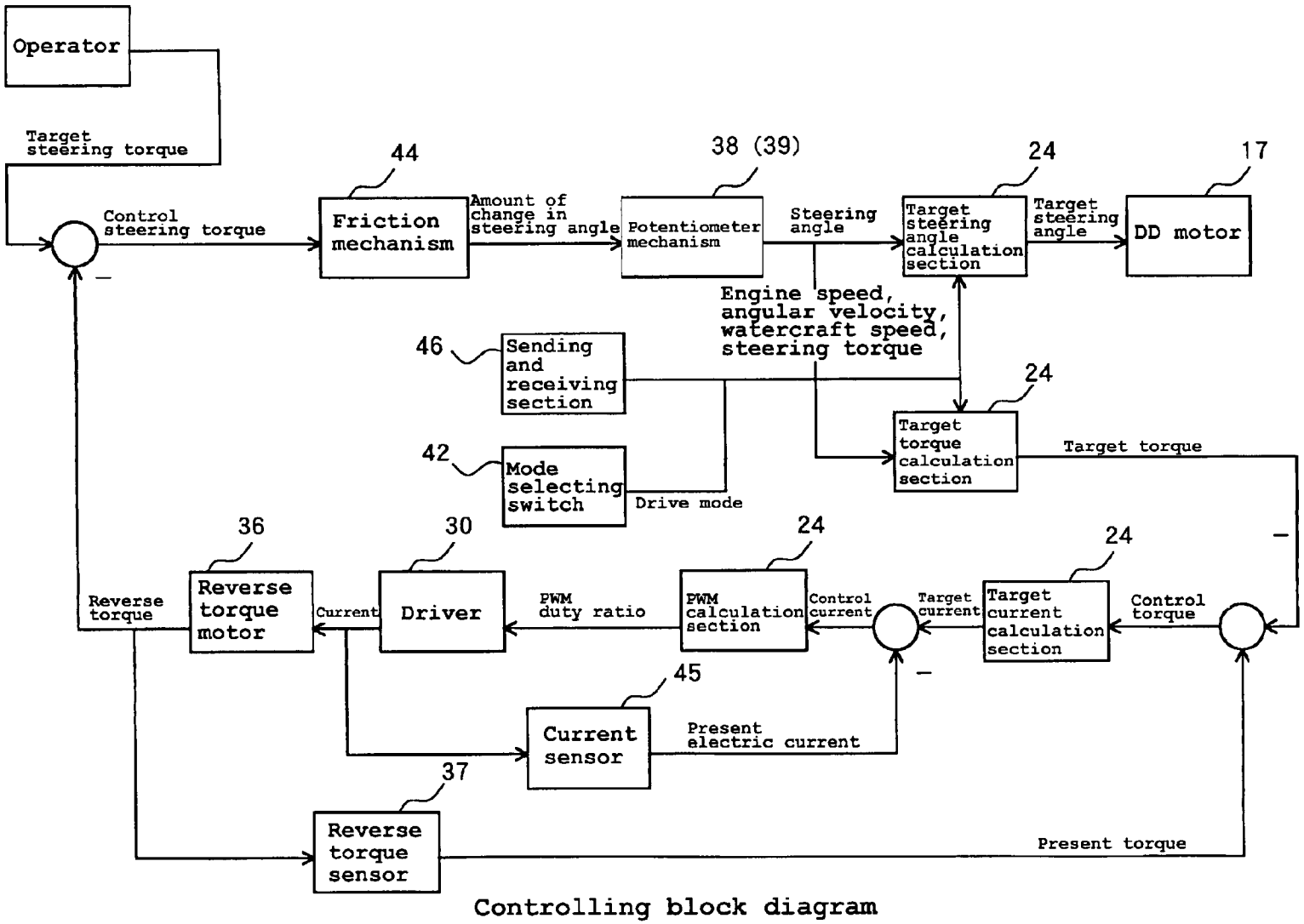
FIG. 4 is a block diagram, illustrating an exemplary operation of steering control method of an embodiment.

FIG. 4 is a block diagram of an ECU 23 having a processing circuit (e.g. CPU 24) configured to execute a steering control program in accordance with an embodiment. This block diagram shows a configuration of an ECU 23, which is provided on the steering wheel side and on the actuator side. The ECUs 23 on the steering wheel side and on the actuator side transmit information to each other via the network for steering control.

Figure 3:
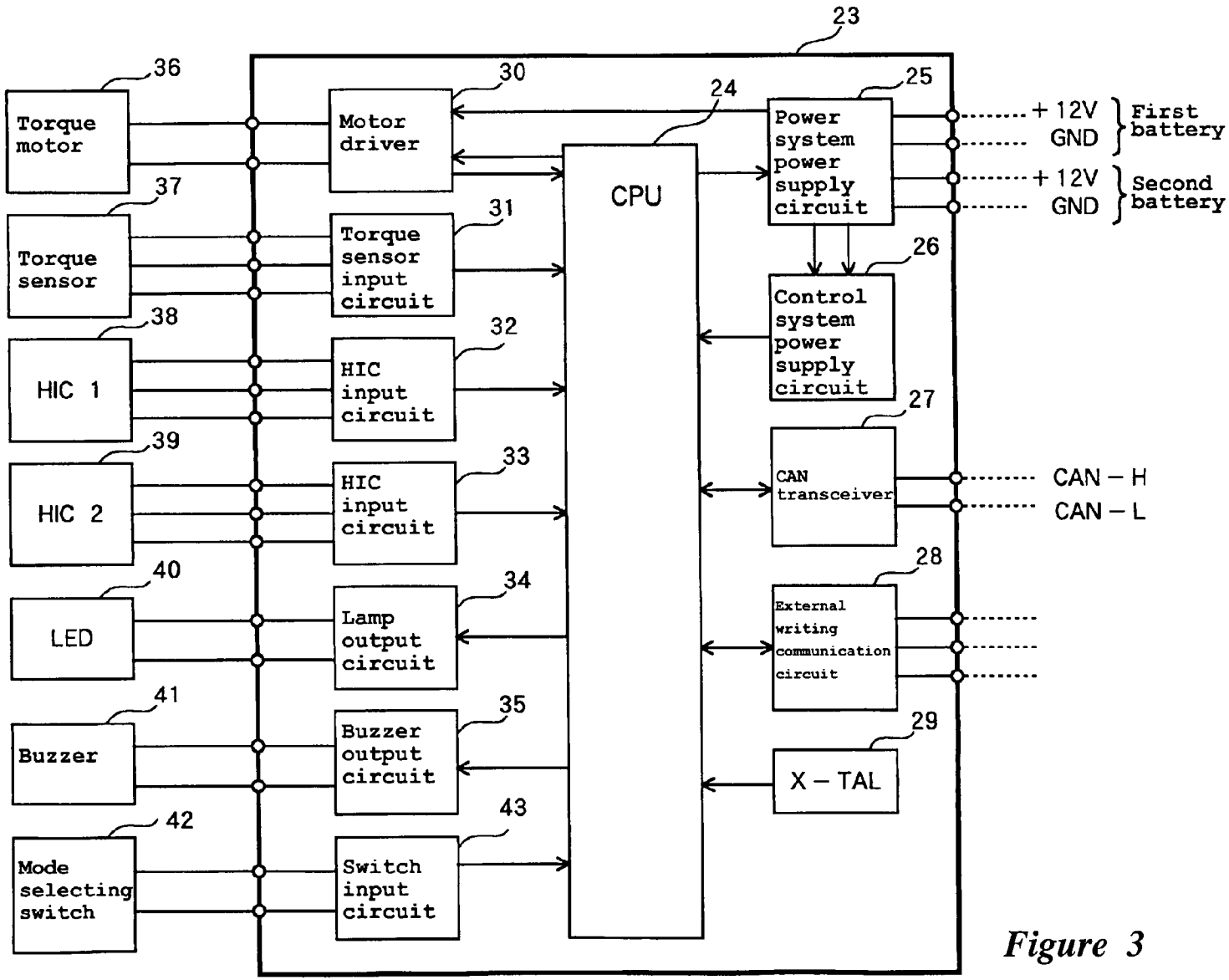
FIG. 3 is a schematic diagram of an Electronic Control Unit (ECU) configured for executing a steering control method in accordance with an embodiment.

With reference to FIG. 3, an ECU 23 can include a CPU 24 including a microcomputer with a stored steering control program. Additionally, the ECU 23 can include a power system power supply circuit 25, a control system power supply circuit 26, a CAN transceiver 27, an external writing communication circuit 28, an oscillating circuit 29, a motor driver 30 connected to a torque motor 36, a torque sensor input circuit 31 connected to a torque sensor 37, two HIC (hall element) input circuits 32 and 33 connected to HICs 38 and 39, respectively, a lamp output circuit 34 connected to an LED 40, a buzzer output circuit 35 connected to a buzzer 41, and a switch input circuit 43 connected to a mode selecting switch 42, although other configurations are also possible. The electronic control unit 23 can be mounted in the steering angle detecting device 9 or the controller 11 of FIG. 1 described above.

The power system power supply circuit 25 can be connected to a first battery and a second battery. In such embodiments, the power system power supply circuit 25 inputs power from the first and the second batteries to the control system power supply circuit 26 through two separate lines, and supplies either of the battery power to the motor driver 30 through a switching circuit such as a relay (not shown) in accordance with a command from the CPU 24. In some embodiments, a battery switching program that is executed by the CPU 24 can be configured such that one of the two batteries is connected as a driving power supply to the motor driver 30 through the switching circuit when the engine is started, or when the watercraft leaves a port, and when battery function is decreased during running, the other battery is selected.

Alternatively, a battery selecting program in the CPU 24 can be configured such that a comparison is made in function between the two batteries, based on their respective voltage and electric current to the motor or on their respective residual amounts, and then the battery with higher function is selected. Such a configuration can be preferable because, immediately after the power is turned on and before the watercraft leaves a port, the two battery power supplies are each checked for capacity and function, and the motor is checked for operability, and the operator is alarmed about any abnormalities by the LED and the buzzer to deal with them before leaving a port.

After the power is activated, a physical parameter selecting signal selected by the mode selecting switch 42 is input to the CPU 24 through the switch input circuit 43. The CPU 24 determines the steering mode for use in calculation of a target steering amount, based on the input mode selecting signal, calculates the target steering amount, and drives the torque motor 36 through the motor driver 30. The steering mode selected by the mode selecting switch 42 is indicated by an LED 40. A dot matrix LCD can be used in place of the indication by the LED 40.

The control system power supply circuit 26 separates the two-line battery power from the power system power supply circuit 25 with a diode or the like to permit one-way flow and has a function of transmitting the two-line battery power to the CPU 24, and a constant-voltage function of converting the two-line battery power into appropriate voltage required for operating the CPU 24.

The motor driver 30 amplifies a PWM control signal from the CPU 24 by the battery power supplied from the power system power supply circuit 25 through the switching circuit. As such, the motor driver 30 can control the torque motor 36 provided at the steering wheel 7. Additionally, the motor driver 30 can transmit electric current from the torque motor to the CPU 24.

In some embodiments the CPU 24 can be configured to detect battery voltage supplied to the torque motor 36, and to transmit a power supply switching command to the power system power supply circuit 25 when battery function is decreased to a specified value or below. The CPU 24 can also light (or flash) the LED 40 through the lamp output circuit 34 to indicate the decreased battery function. Additionally, the CPU 24 can activate the buzzer 41 through the buzzer output circuit 35 to further notify the operator of the decreased functioning of the battery. The CPU also sends a signal indicating the state of decreased battery function to the outside (the operating seat, for example) through the CAN transceiver 27.

The external writing communication circuit 28 is a circuit configured for rewriting the programs in the CPU 24. Reference numeral 29 denotes an oscillating circuit for the CPU 24.

The torque sensor 37 detects reverse torque of the steering wheel 7 and the torque motor 36 when the torque motor 36 is driven in accordance with a steering angle. The torque sensor 37 can also be used with the motor driver 30 to provide feedback-control for generating the desired steering amount.

The HICs 38 and 39 can be used as potentiometers for detecting a steering angle. The use of the two HICs 38 and 39 improves reliability of detecting a steering angle.

FIG. 4 is a block diagram illustrating a steering control method according to an embodiment. During operation, movement of the steering wheel 7 causes the steering shaft 8 to rotate. Resistance can be applied to the steering shaft through a friction mechanism 44. The change in steering angle is detected by a potentiometer mechanism, which, in some embodiments, can include the HICs 38 and 39. The detected degree of operator's steering displacement is input to a target steering amount calculating section of the CPU 24.

Detection signals indicative of engine speed, angular speed, watercraft speed, steering torque and the like from various sensors can be input to the target steering amount calculation section of the CPU 24. In some embodiments, the signals are received through a transmitting and receiving section 46.

A steering mode selected through an operator's control of the mode selecting switch 42 can also be input to the target steering amount calculation section 24. The target steering amount calculation section 24 can calculate a target steering amount based on the selected steering mode, using a signal indicative of the degree of operator's steering displacement (steering angle) from the potentiometer mechanism 38, as well as other operating conditions. For example, the target steering amount calculation section 24 can be configured to use operating conditions such as, for example but without limitation, engine speed, angular speed, watercraft speed, steering torque, and optionally other parameters, as a basis for correcting the target steering amount. The target steering amount calculation section 24 can also send a corresponding command signal to the DD-type motor 17, to steer the outboard motor 3.

Table 1 shows an example of a steering drive mode to be selected by the mode-changing switch.

TABLE 1

| | Steering factors | |
|---|---|---|
| Steering mode | Delay | Gain |
| Cruising | Middle | Middle |
| Trolling | Large | Small |
| Sports | Small | Large |

In this example, the steering system can operate in at least a cruising mode, a trolling mode and sports mode as selectable modes, although other modes, additional modes, or fewer modes can also be used. The cruising mode can be a control pattern suited for an ordinary running to a destination after departure, including a high speed constant running condition. The trolling mode can be a control pattern suited for a running at a constant low speed, for example, at the time of fishing, including a low speed constant running condition close to an idle engine speed. The sports mode can be a running mode in which the steering wheel is operated quickly as in water-skiing.

Each mode can have delay and gain values established as steering factors that can be used to calculate a target steering angle. As described below, the delay represents a response lag to the steering wheel movements (steering inputs); the smaller the response lag is, the shorter the response time becomes resulting in quick response to the steering wheel movements. The gain represents the proportional amount of steering (angular displacement of the propulsion unit) to the steering wheel angle (steering operation angle). In the illustrated embodiment, the DD motor is driven such that the propulsion unit is rotated through proportionally larger angles relative to the steering wheel operation movements when operating under a larger gain.

The delay and gain of each steering drive mode is as shown in the table. The CPU 24 calculates a target steering angle based on the delay and gain of the steering mode selected by the operator.

Figure 5:
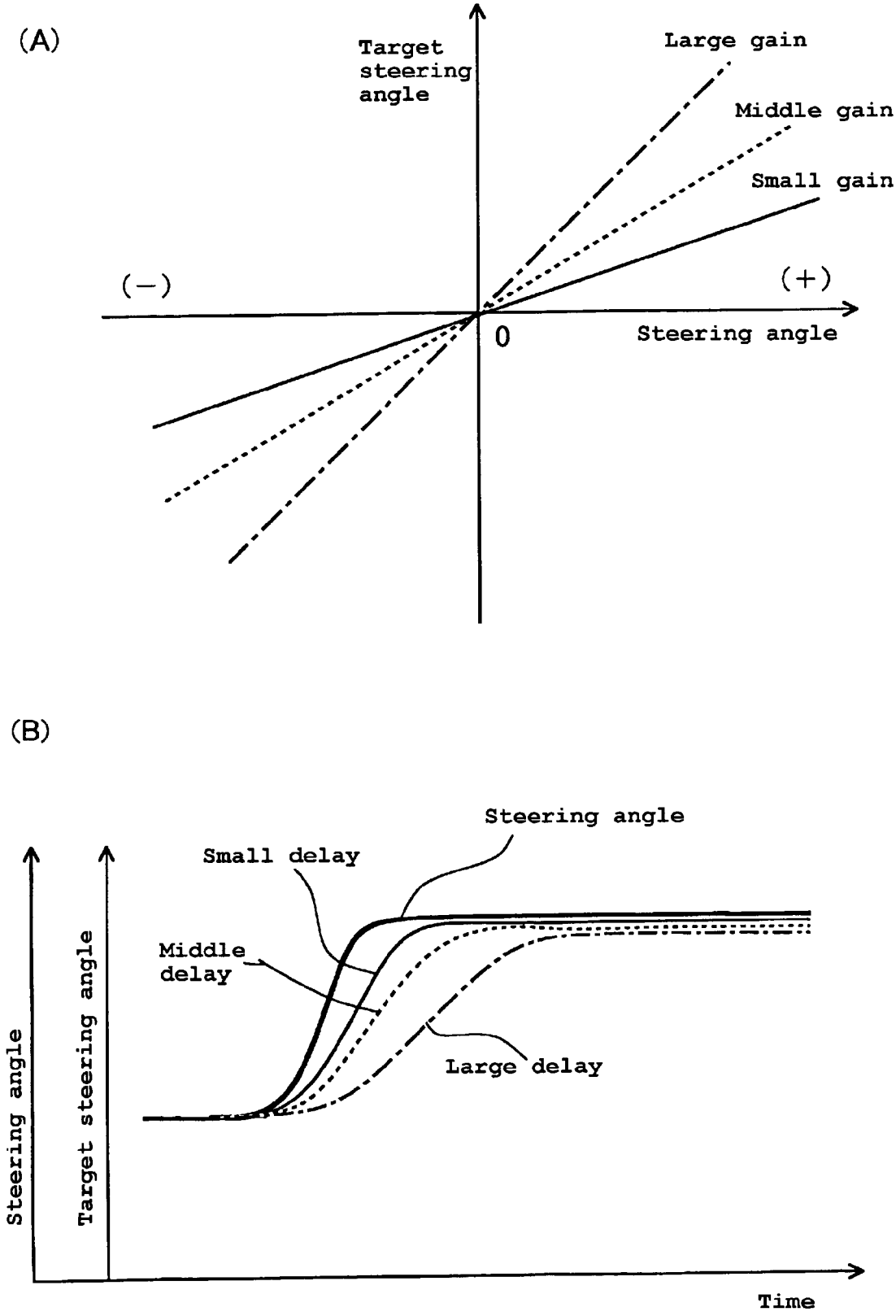
FIG. 5(A) is a graph illustrating exemplary proportional relationships between a steering input angle and target steering angle for a plurality of different gain values.
FIG. 5(B) is a graph illustrating the response timing or lag of the steering system response to steering inputs for a plurality of different lag values.

FIGS. 5(A), (B) include representations of steering system response delay and gain. As shown in FIG. 5(A), the larger the gain, the larger the target steering angle becomes relative to the input steering angle.

As shown in FIG. 5(B), the target steering angle is reached more quickly with a quicker response when operating under a smaller delay value. On the other hand, when the delay value is larger, the target steering angle is reached more slowly with a slower response to steering inputs.

When the CPU 24 drives the torque motor 36 in accordance with a calculated target steering amount, it causes a target torque calculation section 24 and a target electric current calculation section 24 to calculate target torque and target electric current, respectively. Feedback-control can be used to control current torque and electric current, and to determine control steering torque and to calculate the target steering amount, as shown in FIG. 4.

In the foregoing embodiment, the ECU 23 for the steering drive unit 15 comprising an electric steering mechanism can be disposed inside the steering drive unit 15. This eliminates the need to mount the ECU 23 for electric steering as a separate component, thereby simplifying a construction and preventing increase in standard price when the ECU 23 is available as an option for an outboard motor.

Where two or more outboard motors are used together, a plurality of steering actuators are preferably operable with a single steering wheel. In a dual outboard motor embodiment, when different steering control signals are sent to the left and right actuators in accordance with operator's steering wheel control, the two outboard motors can be moved in mutual directions so that an optimum steering angle is achieved in accordance with operating states such as a straight forward motion, turning, running at high speed or low speed, and a forward or reverse motion, and also the watercraft can laterally move.

The ECU 23 described above can include a CPU configured for calculating a steering angle or other control parameters, configured to provide a motor driver function for driving an actuator and a torque motor, and a LAN communication function as a communication line adapted to drive those components. This provides for enhanced control of steering speed, steering torque, and a steering angle range, as well as control in consideration of information on a shift position, throttle opening, engine speed, watercraft speed and the like without additional wiring of a LAN.

The steering wheel 7 can be in other forms. For example, but without limitation, a joystick 7' (FIG. 1) can be used in place of the steering wheel 7. This embodiment allows effective control such as, in particular, a lateral motion and holding fixed points.

Power can be supplied through two lines. The steering wheel 7 can optionally be provided with a steering mode selecting switch 42, a vibrator, a lamp, and a buzzer. This provides effective and redundant means for notifying an operator of a power malfunction and also provides the operator with a conveniently placed control for switching to the other power supply when one power supply is lost or reduced in function.

Further, steering control is allowed in a steering mode in accordance with operator's preferences, so that a steering feeling is improved. The vibrator on the steering wheel allows the operator to detect operating states and abnormal states through his/her hands that grip the steering wheel, or touch, as well as through eyes and ears.

In some embodiments, as noted above, the power supply can be automatically switched by the determination of the CPU based on the state of the battery voltage or the like. This provides automatic response for dealing with any failure before the influence of the failure occurs. For example, the power supply can be switched through a fail-safe mechanism, independently of operator's manual control.

Some boats include multiple pilot or operating stations. In embodiments used in conjunction with boats having multiple operator stations, the mode selecting switch and the lamp can be combined with an operating station selecting switch. This better uses the space available in the hull of a watercraft having a plurality of operating stations, providing a more compact arrangement.

Abnormalities can be indicated by a flashing lamp, such as the lamp 40. Further, a diagnosing function can be provided which indicates specific positions and parts with abnormalities by the number of times that the lamp flashes. In this case, the lamp can be an LED or a dot-matrix LCD which can be configured to display characters and/or graphics. This allows the operator to easily identify failures, so that he/she can promptly deal with it.

An inputting section of information on engine speed, angular speed, and watercraft speed can be provided to limit a target steering angle or give a delayed response in accordance with the input values. This prevents the watercraft from turning at a speed that the operator does not intend, and thus achieves a more optimum steering feeling.

An inputting section of information on engine speed, angular speed, and watercraft speed can also be used in conjunction with a device for producing reverse torque to operator's steering force. For example, a torque motor such as the torque motor 36, or other actuator, can be connected to the steering wheel to produce reverse torque in accordance with the input information. Reverse torque can be controlled through feedback control by a reverse torque sensor, such as the torque sensor 37, configured to detect torque applied to the steering wheel 7. In this case, reverse torque is produced to act against the user inputs to thereby provide a tactile feedback to the operator and thus inhibit sudden movements of the steering wheel 7. In some embodiments, the torque motor 36 can be controlled so as to increase such reverse torque with increases in engine speed and watercraft speed. This provides enhanced stability during running at high speed as well as operability when the watercraft leaves and arrives at the shore, and allows steering control in a manner such that the operator feels actual steering torque through his/her hands and a good steering feeling is achieved. Further, in some embodiments, the motor and sensors can be combined into integrated assemblies, so that assemblability and rigging performance are improved along with simplified wiring of the LAN.

An inputting section of information on angular speed, steering torque, and steering angle can also be used to make fine adjustments of a target steering angle in accordance with the input values. Such an embodiment can provide enhanced steering control that reduces the need for the operator to counter-steer, or to manually make fine adjustments to the steering wheel 7, thereby providing a more comfortable riding experience.

An angular speed sensor can also be configured as a vibration sensor and disposed in an actuator, such as the torque motor 36. As such, the vibration sensor can be used to identify vibrations or higher frequency movements of the steering wheel. Such vibrations and/or higher frequency movements can be filtered out, ignored, or processed in another manner by the ECU 23 to reduced abrupt steering controls as well as simplify a construction.

An inputting section of electric current to the motor can also be used to detect an increase in steering resistance caused by, for example, but without limitation, salt crystal formation. For example, changes in the amount of electric current required for similar steering movements of the outboard motor can be used to identify an increasing resistance. As such, the operator can be notified of an increase in steering resistance so that the operator can promptly deal with it. In some embodiments, the ECU 23 can be configured to perform a steering system check for abnormalities such as salt crystal formation. For example, the ECU 23 can be configured to perform an initial operation in which the actuator is moved to the right and to the left, immediately after the power is turned on and when a transmission is in neutral, and to compare the electric currents required with predetermined electric current values. Preferably, the operator is alarmed about such abnormalities by the steering wheel or any other indicators, or an alarm device such as a buzzer via a LAN.

In the case of mounting a plurality of outboard motors, steering can be controlled cooperatively through information exchange between mutual actuators. In this case, a single actuator may be set as a control reference actuator. Optionally, an appropriate command can be sent to each actuator from the steering wheel. This allows the operator to steer a plurality of outboard motors with the same steering feeling as with when he/she operates a single outboard motor, and thus provides smooth cooperative steering control.

A control parameter based on various information from the information inputting section can be changed using a genetic algorithm, for steering control based on learned data. This allows appropriate steering control of individual watercrafts based on an operating history in a steering mode in which operating states change with a high frequency, independently of the number of the engine, horsepower, the type of the watercraft, or the like.

When these embodiments are used for an outboard motor on a small watercraft which cruises at sea, optimum steering control is allowed in accordance with operating states and an ambience during running, so that a steering feeling is improved and a significant effect is obtained.

Although the present inventions have been described in terms of a certain preferred embodiments, other embodiments apparent to those of ordinary skill in the art also are within the scope of the inventions. Thus, various changes and modifications may be made without departing from the spirit and scope of the inventions. For instance, not all of the features, aspects and advantages are necessarily required to practice the present inventions. Accordingly, the scope of the present inventions is intended to be defined only by the claims that follow.

What is claimed is:

1. A method of steering a watercraft propulsion device mounted to a transom plate of a watercraft, the propulsion device having a steering input device configured for operation by an operator of the watercraft and a steering drive unit configured to allow the watercraft propulsion device to swivel about a swivel shaft, the propulsion device having a forward drive mode, the method comprising the steps of:

detecting a displacement of the steering input device;

detecting which of a plurality of predetermined steering system forward drive mode response performance options has been selected by an operator of the watercraft, each of the plurality of predetermined steering system forward drive mode response performance options corresponding to different steering factors indicative of the amount of actuation of the steering drive unit, the different steering factors defining different direct relationships between the displacement of the steering input device and a rotational position of the propulsion device about the swivel shaft during operation of the propulsion device at least in the forward drive mode;

calculating a steering control amount for the steering drive unit in accordance with the degree displacement of the steering input device and the selected predetermined steering system response performance option; and operating the steering drive unit based on the calculated steering control amount.

2. The steering control method according to claim 1, wherein each of the steering factors includes at least one of a response speed to the steering operation and an amount of response to the steering operation angle.

3. The steering control method of claim 1, wherein the plurality of predetermined steering system forward drive mode response performance options includes at least two of a cruising mode, a trolling mode, and a sports running mode.

4. The steering control method of claim 2, wherein the plurality of predetermined steering system forward drive mode response performance options includes at least two of a cruising mode, a trolling mode, and a sports running mode.

5. The steering control method according to claim 1, wherein the steering drive unit comprises an electric motor.

6. The steering control method according to claim 2, wherein the steering drive unit comprises an electric motor.

7. The steering control method according to claim 4, wherein the steering drive unit comprises an electric motor.

8. The steering control method according to claim 1, wherein each of the steering factors includes at least one of a delay value and a gain value.

9. The steering control method according to claim 1, wherein the watercraft propulsion device comprises a propeller.

10. A method of steering a watercraft having a hull, marine propulsion device, the propulsion device being mounted so as to swivel and thus change its rotational position relative to the hull, the propulsion device having a steering input device configured for operation by an operator of the watercraft, the propulsion device having a forward drive mode, the method comprising the steps of:

detecting an input to the steering input device;

detecting which of a plurality of predetermined steering system forward drive mode response performance options has been selected, each of the plurality of predetermined steering forward drive mode system response performance options defining a different direct relationship between the rotational position of the propulsion device and inputs into the steering input device during operation of the propulsion device at least in the forward drive mode;

calculating a steering control amount in accordance with the input of the steering input device and the detected steering system response performance option, where the predetermined steering system response performance option is selected by the operator; and changing the angular position of the marine propulsion device relative to the hull based on the calculated steering control amount so as to steer the watercraft.

11. The steering control method of claim 10, wherein the plurality of predetermined steering system forward drive mode response performance options includes at least two of a cruising mode, a trolling mode, and a sports running mode.

12. The steering control method of claim 10, wherein the marine propulsion device comprises an outboard motor.

13. The steering control method of claim 10, wherein the input device comprises a joystick.

14. The steering control method of claim 10, wherein the input device comprises a wheel.

15. The steering control method of claim 10, wherein the input device comprises an electronic device.

16. The steering control method according to claim 1, wherein at least two of the different steering factors include different response speeds to changes in displacement of the steering input device during operation of the propulsion device in the forward drive mode.

17. The steering control method according to claim 10, wherein at least two of the of the plurality of predetermined steering system forward drive mode response performance options define different response speeds to inputs to the steering input device during operation of the propulsion device in the forward drive mode.

18. The steering control method according to claim 1, wherein at least two of the different steering factors include different delay values relating to responses to changes in displacement of the steering input device during operation of the propulsion device in the forward drive mode.

19. The steering control method according to claim 10, wherein at least two of the of the plurality of predetermined steering system forward drive mode response performance options define different delay values relating to responses to inputs to the steering input device during operation of the propulsion device in the forward drive mode.

* * * * *

UNITED STATES PATENT AND TRADEMARK OFFICE

CERTIFICATE OF CORRECTION

PATENT NO. : 7,497,746 B2
APPLICATION NO. : 11/047123
DATED : March 3, 2009
INVENTOR(S) : Takashi Okuyama It is certified that error appears in the above-identified patent and that said Letters Patent is hereby corrected as shown below:

On the Title Pg at Page 1 (Item 57) Abstract, line 10, change "be," to --be--.

On the Title Pg at Page 1 (Item 57) Abstract, line 11, change "plurality of plurality of" to --plurality of--.

At column 1, line 19, change "stem" to --stern--.

At column 9, line 48, in claim 7, change "4," to --3,--.

At column 10, line 41, in claim 17, change "of the of the" to --of the--.

At column 10, line 52, in claim 19, change "of the of the" to --of the--.

Signed and Sealed this

Twentieth Day of April, 2010

David J. Kappos

David J. Kappos
*Director of the United States Patent and Trademark Office*